US009050852B1

(12) United States Patent
Abuzarifah

(10) Patent No.: US 9,050,852 B1
(45) Date of Patent: Jun. 9, 2015

(54) PAINT CONTAINER AND LID CONSTRUCTION

(71) Applicant: Khalid Abuzarifah, Fall River, MA (US)

(72) Inventor: Khalid Abuzarifah, Fall River, MA (US)

( * ) Notice: Subject to any disclaimer, the term of this patent is extended or adjusted under 35 U.S.C. 154(b) by 0 days.

(21) Appl. No.: 14/096,148

(22) Filed: Dec. 4, 2013

(51) Int. Cl.
*B05C 21/00* (2006.01)
*B44D 3/12* (2006.01)
*B05C 17/02* (2006.01)

(52) U.S. Cl.
CPC ..... *B44D 3/127* (2013.01); *B44D 3/126* (2013.01); *B05C 17/0245* (2013.01); *B65D 2543/0025* (2013.01)

(58) Field of Classification Search
CPC ..... B65D 2543/0025; B44D 3/126; B05C 17/0245
USPC ..... 220/212, 699–702, 570, 801; 215/246, 215/384
See application file for complete search history.

(56) References Cited

U.S. PATENT DOCUMENTS 3,537,610 A * 11/1970 Bilon ..... 220/258.4
3,820,690 A * 6/1974 Musher ..... 222/490
4,865,216 A 9/1989 Landis
5,472,111 A 12/1995 Renfrew
6,015,061 A * 1/2000 Lowry ..... 220/287
6,102,235 A 8/2000 Stern et al.
6,161,711 A * 12/2000 Miceli et al. ..... 215/206
6,269,967 B1 8/2001 de Vries
2002/0017502 A1 * 2/2002 Renz ..... 215/384
2006/0261065 A1 11/2006 Claypool et al.
2009/0127266 A1 * 5/2009 Arvinte et al. ..... 220/570
2013/0140311 A1 6/2013 Roy et al.

FOREIGN PATENT DOCUMENTS

EP 0 417 331 3/1991

* cited by examiner

*Primary Examiner* — Fenn Mathew
*Assistant Examiner* — James N Smalley
(74) *Attorney, Agent, or Firm* — Salter & Michaelson

(57) ABSTRACT

A combination paint container and tray that includes a container for a supply of a paint product including a base and an upper peripheral closure edge, and a lid constructed and arranged as a paint tray structure having first and opposed second peripheral edge elements. The paint tray has a storage position relative to the container and an opposite use position relative to the container. The paint tray, in the storage position thereof, has the first peripheral edge element for sealed engagement with the upper peripheral closure edge of the container. The paint tray, in the use position thereof, has the opposed second peripheral edge element for positioning on the upper peripheral closure edge of the container. The paint tray, in the use position, is provided with a paint receiving tray surface for receiving a supply of paint.

21 Claims, 13 Drawing Sheets

PAINT CONTAINER AND LID CONSTRUCTION

FIELD OF THE INVENTION

The present invention relates in general to a paint container and associated lid construction. More particularly, the present invention relates to a paint container and lid construction in which the lid construction forms a paint roller tray that is engageable with the container in opposed positions. Although the primary use of the present invention is in connection with paint containers, the principles of the invention also apply to any liquid container.

BACKGROUND OF THE INVENTION

There presently exists a number of prior art patents that generally relate to paint containers and associated paint rollers. By way of example, refer to U.S. Pat. No. 5,472,111 to Renfrew. This patent describes a paint roller tray that is detachably mounted on a paint container. One of the drawbacks associated with this particular arrangement is that this requires, not only the container and tray, but also a separate lid for sealing the container.

Refer also to U.S. Pat. No. 6,102,235 to Stern et al. that describes a paint container lid with a self-supporting paint roller tray that pivots from the lid structure. In this patent as well as the '111 patent, it is noted that the constructions that are used are relatively complex and do not provide an effective and simple construction for providing the sealing of the lid with the container as well as the forming of an effective paint roller tray.

Accordingly, it is an object of the present invention to provide an improved paint container and associated roller tray. More particularly, this is accomplished in accordance with the present invention by providing a reversible lid having an engaging side for sealing with the container and an opposed resting surface side for engagement with an upper peripheral closure edge of the container.

Another object of the present invention is to provide an improved paint container and associated tray construction that is relatively simple in construction and that has opposed positions including a "storage" position in which one side of the tray construction is sealed with the top of the container and an opposed "use" position in which the tray is reversed in position and can rest upon the top surface of the container.

SUMMARY OF THE INVENTION

To accomplish the foregoing and other objects, features and advantages of the present invention there is provided a combination paint container and tray, comprising: a container for a supply of a paint product including a base and an upper peripheral closure edge; and a lid constructed and arranged as a paint tray structure having first and opposed second peripheral edge elements. The paint tray has a storage position relative to the container and an opposite use position relative to the container. The paint tray, in the storage position thereof, has the first peripheral edge element for sealed engagement with the upper peripheral closure edge of the container. The paint tray, in the use position thereof, has the opposed second peripheral edge element for positioning on the upper peripheral closure edge of the container. The paint tray, in the use position, is provided with a paint receiving tray surface for receiving a supply of paint.

In accordance with other aspects of the present invention, in the storage position thereof, the first peripheral edge element of the paint tray is constructed and arranged for releasable interlocking engagement with the upper peripheral closure edge of the container, in the use position thereof, the second peripheral edge element of the paint tray is constructed and arranged for resting engagement on the upper peripheral closure edge of the container; wherein the container, adjacent to the upper peripheral closure edge thereof, has a peripheral ledge disposed below the upper peripheral closure edge of the container, and both the first peripheral edge element and the container upper peripheral closure edge are continuous to provide an air tight seal between the container and lid; wherein the first peripheral edge element of the paint tray is disposed inside of the upper peripheral closure edge; wherein the paint receiving tray surface includes a slanted surface and a flange disposed under the paint receiving tray surface in the use position; wherein the flange provides an undersurface that rests on the upper peripheral closure edge of the container; wherein the first peripheral edge element and upper peripheral closure edge have respective facing edge surfaces, and further including a sealing strip that covers the facing edge surfaces to provide an air tight seal about the entire periphery of the paint container and tray; wherein the first peripheral edge element includes a step that is engageable with an end section of the upper peripheral closure edge; including opposed indentation in respective opposed walls defining the container and forming handles for carrying the container; and wherein the container is one of square or rectangular in cross-section so as to be able to stack containers more efficiently.

In accordance with still other aspects and features of the present invention there is provided a paint apparatus that is comprised of a container for a supply of a paint product including a base and an upper peripheral closure edge and a lid that is constructed and arranged as a paint tray structure having first and opposed second sides with each side having respective first and second peripheral edge elements. The paint is ructed to assume opposite positions relative to the container including a storage position and an opposite use position in which the tray is re-positioned through 180 degrees. The paint tray, in the storage position thereof, has the first peripheral edge element for sealed engagement with the upper peripheral closure edge of the container. The paint tray, in the use position thereof, has the opposed second peripheral edge element for positioning on the upper peripheral closure edge of the container. The paint tray, in the use position, has a paint receiving tray surface facing away from the container.

In accordance with still further aspects of the present invention, in the storage position thereof, the first peripheral edge element of the paint tray is constructed and arranged for releasable interlocking engagement with the upper peripheral closure edge of the container, in the use position thereof, the second peripheral edge element of the paint tray is constructed and arranged for resting engagement on the upper peripheral closure edge of the container; wherein the container, adjacent to the upper peripheral closure edge thereof, has a peripheral ledge upon which the first peripheral edge element of the paint tray rests in the storage position, and both the first peripheral edge element and the container upper peripheral closure edge are continuous to provide an air tight seal between the container and lid; wherein the peripheral ledge is disposed below the upper peripheral closure edge of the container so as to dispose the first peripheral edge element of the paint tray either inside or outside of the upper peripheral closure edge; wherein the paint receiving tray surface includes a slanted surface and a flange disposed under the paint receiving tray surface in the use position, and wherein the flange provides an undersurface that rests on the upper peripheral closure edge of the container: wherein the first peripheral edge element and ledge having respective facing edge surfaces, and further including a sealing strip that covers the facing edge surfaces to provide an air tight seal about the entire periphery of the paint container and tray; wherein the first peripheral edge element includes a side lip that is engageable with an end lip of the upper peripheral closure edge.

In accordance with still further aspects and features of the present invention there is provided a method of arranging a paint tray relative to a paint container in which the container is for a supply of a paint product including a base and an upper peripheral closure edge and the tray is formed by a lid that is constructed and arranged as having first and opposed second sides with each side having respective first and second peripheral edge elements, constructing the paint tray to assume opposite positions relative to the container including a storage position and an opposite use position in which the tray is re-positioned through 180 degrees, said paint tray, in the storage position thereof, having the first peripheral edge element for sealed engagement with the upper peripheral closure edge of the container, said paint tray, in the use position thereof, having the opposed second peripheral edge element for positioning on the upper peripheral closure edge of the container, said paint tray, in the use position, having a paint receiving tray surface facing away from the container.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which.

DETAILED DESCRIPTION

Figure 1:
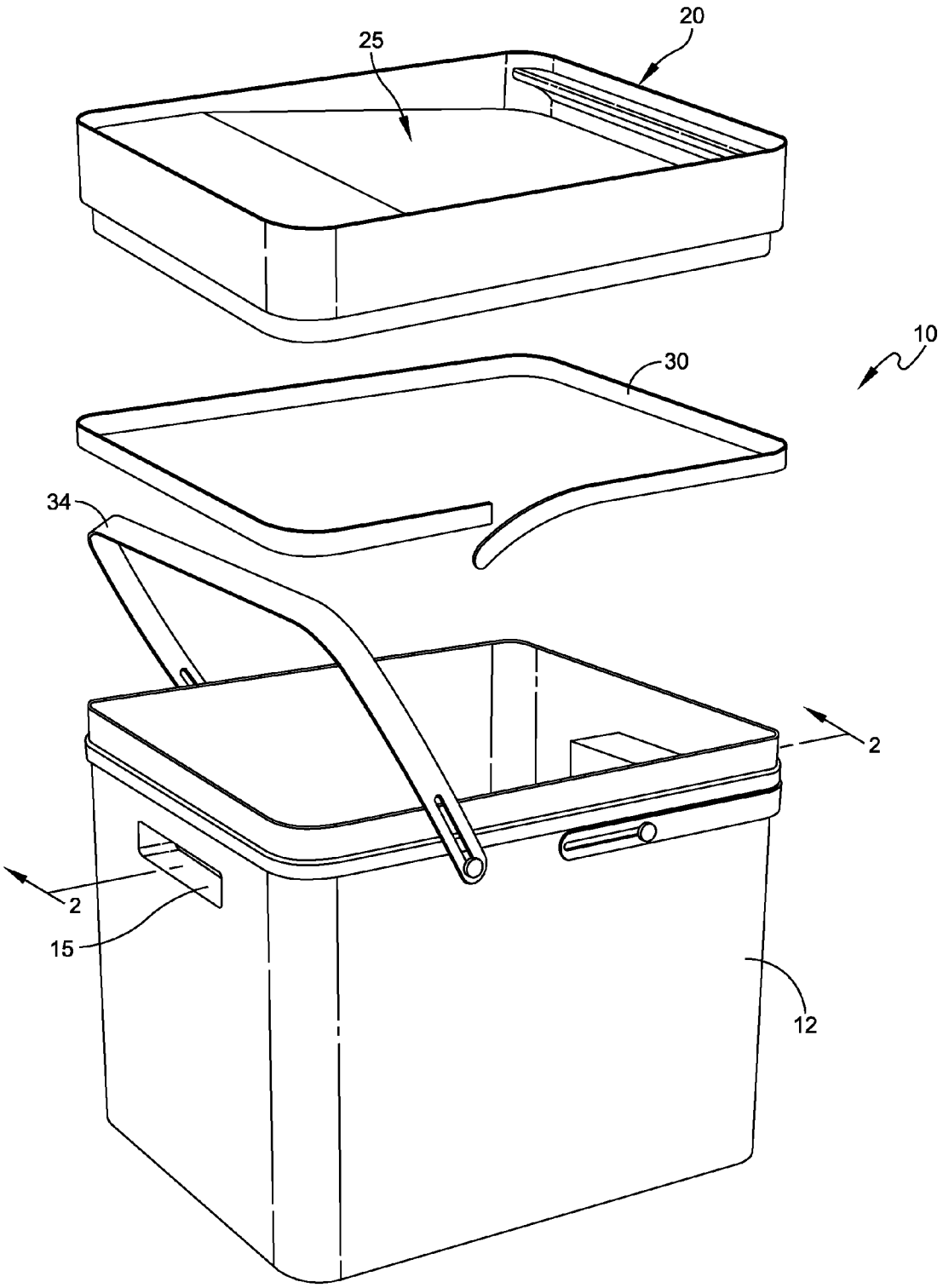
FIG. 1 is a perspective view of the paint container and tray apparatus of the present invention with components exploded in position.
Figure 3:
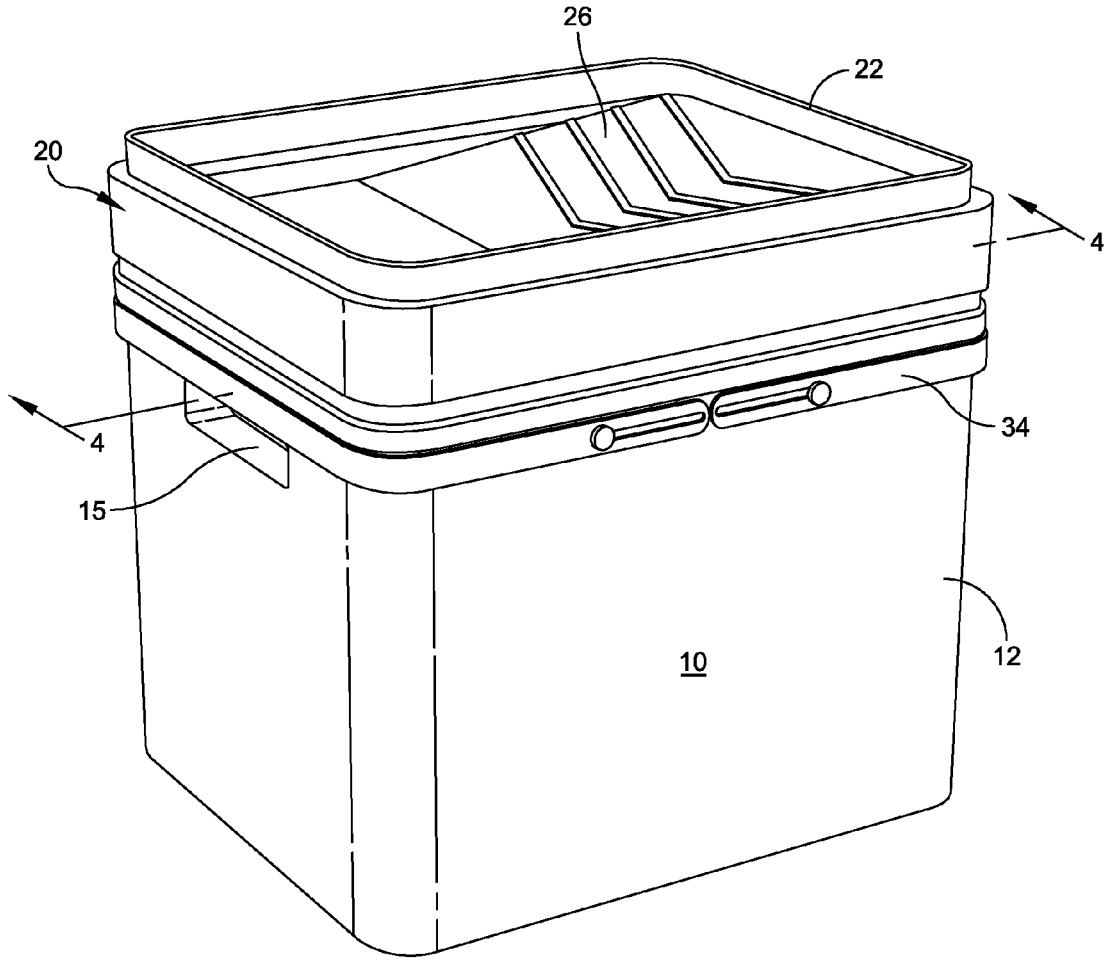
FIG. 3 is a perspective view illustrating the container and tray apparatus of the present invention in the "use" position.
Figure 5:
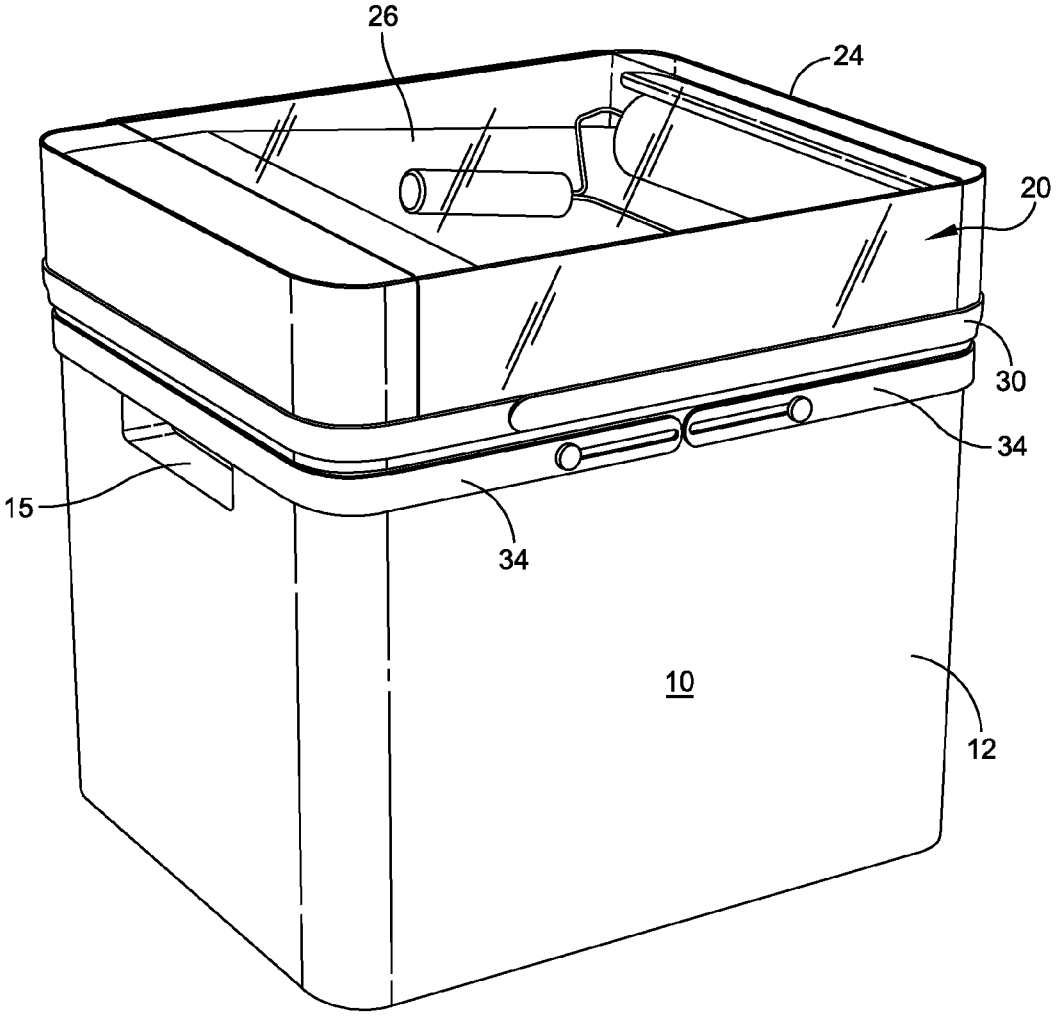
FIG. 5 is a further perspective view similar to that illustrated in FIG. 1 and also disclosing the placement of a roller above the lid.

Reference is now made to the drawings for further details of the combination paint container and tray of the present invention. This apparatus is considered as having both a "storage" position and a "use" position. FIGS. 1 and 5 illustrate the "storage" position. FIG. 3 illustrates the "use" position.

Figure 2:
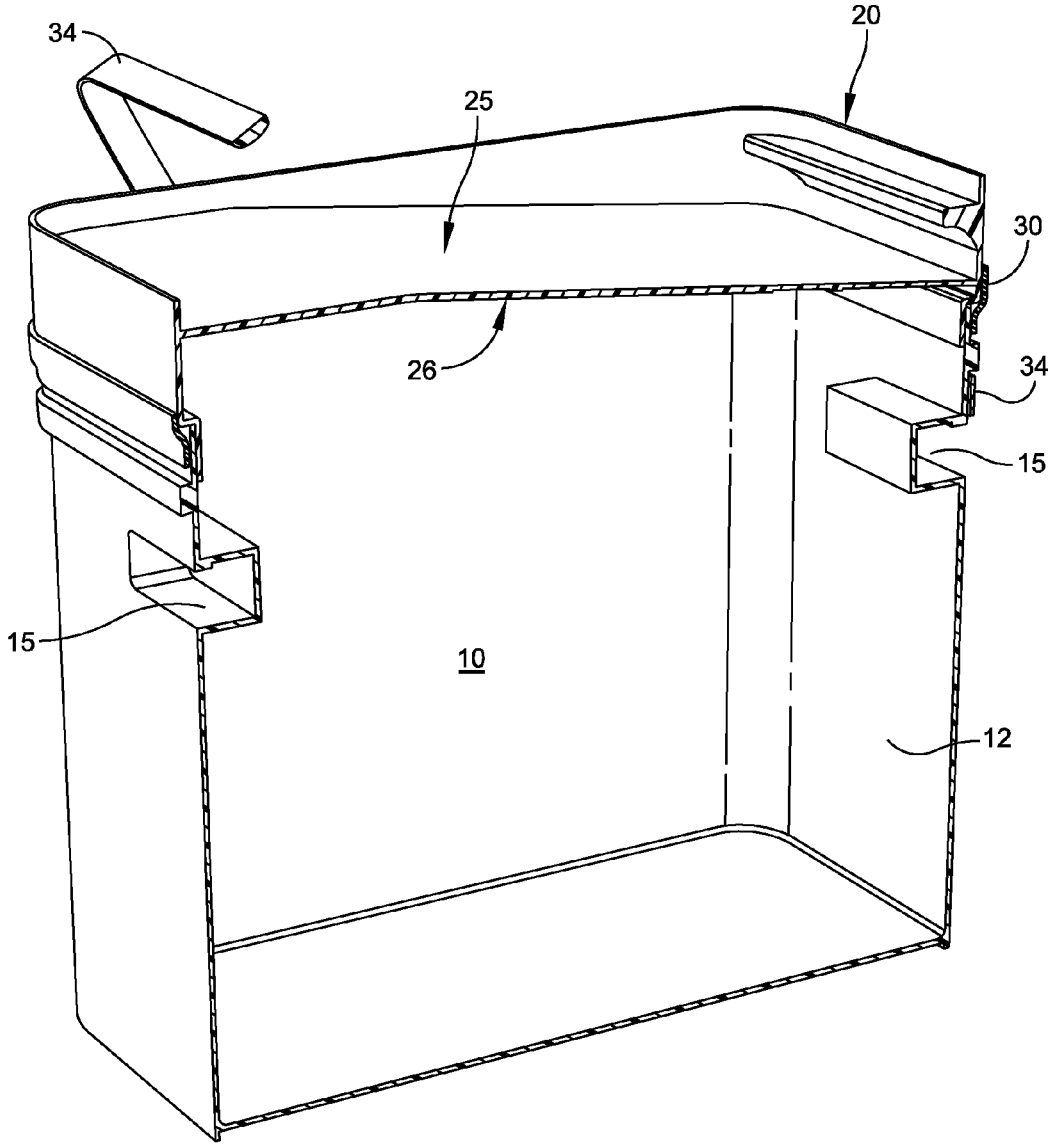
FIG. 2 is a cross-sectional view taken along line 2-2 through the container and lid construction.
Figure 2A:
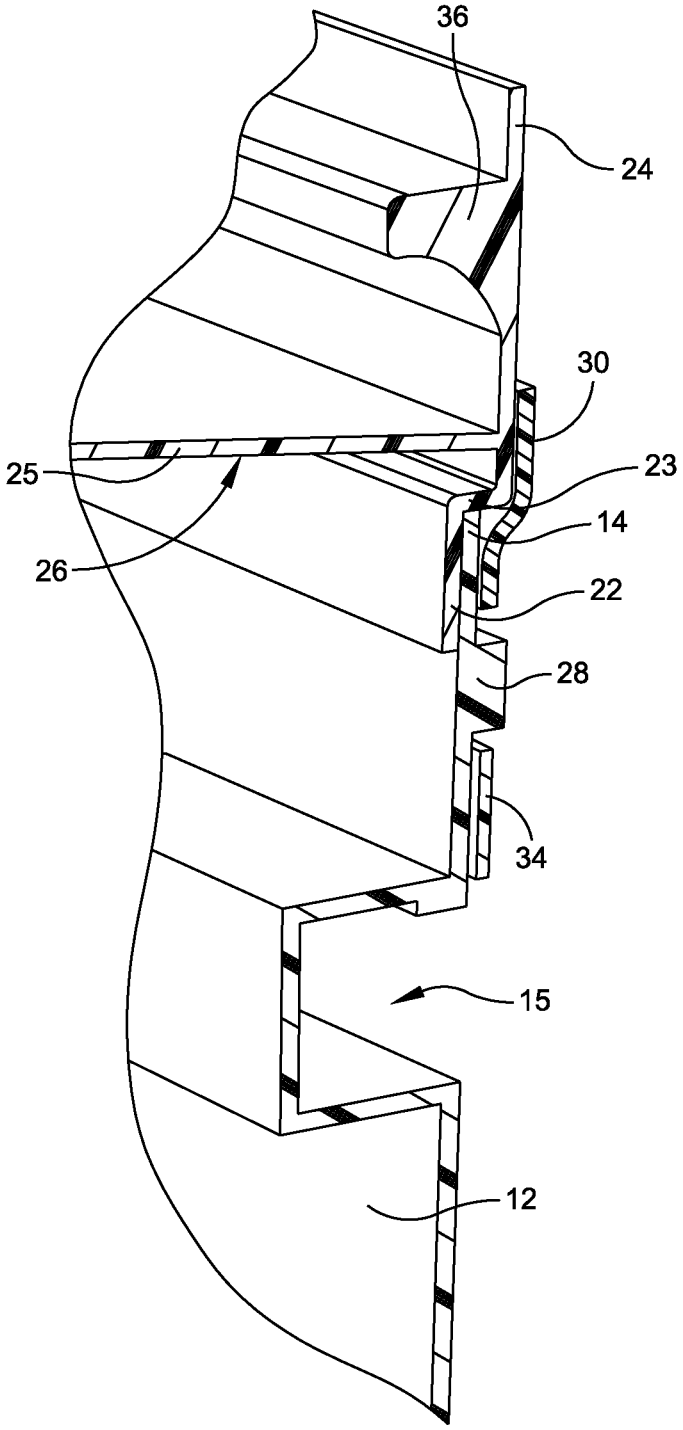
FIG. 2A is a partial cross-sectional perspective taken from a section of the cross-sectional view of FIG. 2.
Figure 4:
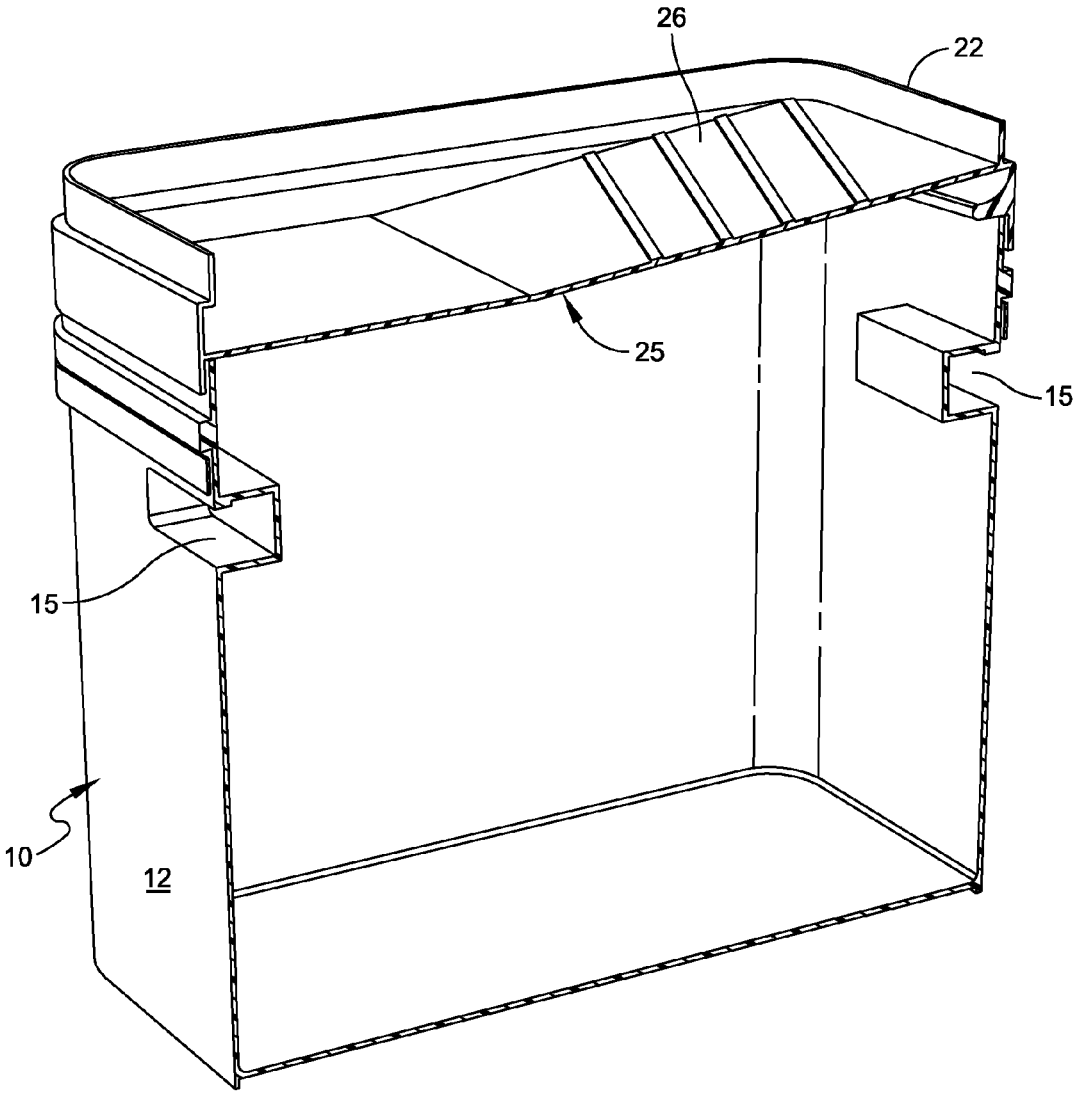
FIG. 4 is a cross-sectional view taken along line 4-4 of FIG. 3.
Figure 4A:
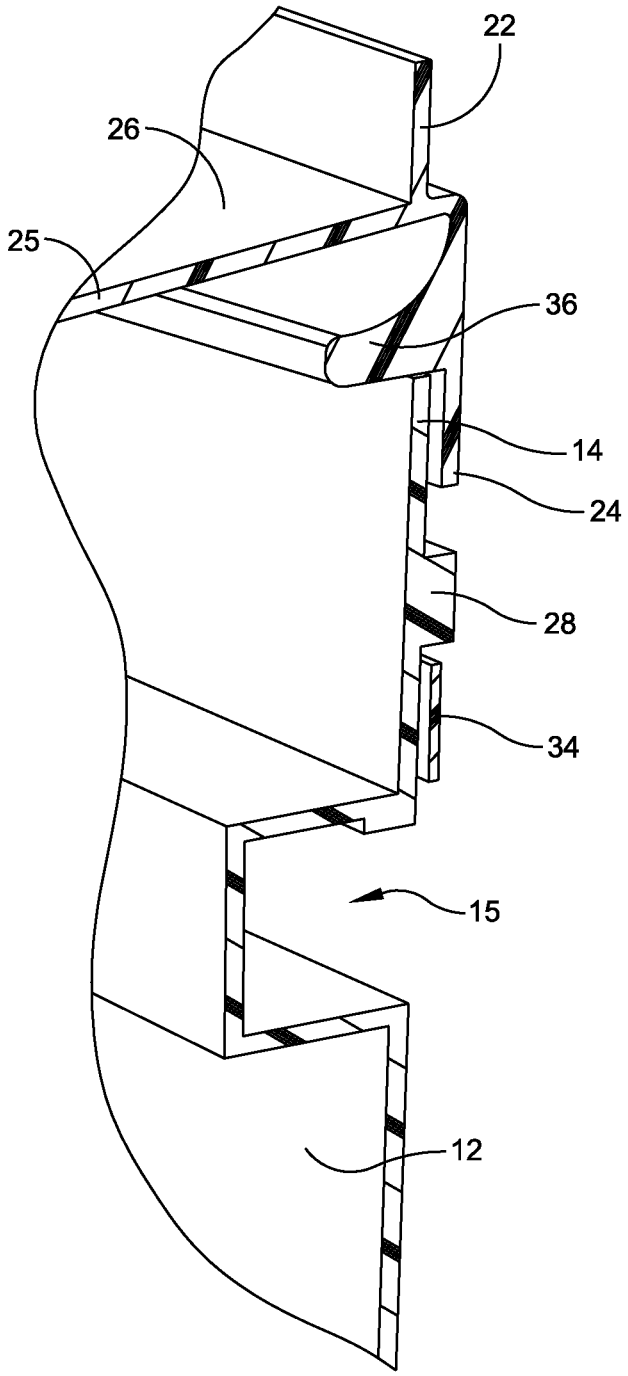
FIG. 4A is a partial perspective cross-sectional view taken from a section of the cross-sectional view of FIG. 4.

The cross-sectional view of FIG. 2A illustrates the "storage" position. The fragmentary cross-sectional view of FIG. 4A illustrates the "use" position.

The combination paint container and tray of the present invention is meant to be sold as illustrated in FIG. 5 and may be additionally provided with a roller nested in the tray, along with some type of a covering over the roller to retain the roller in place. Once the seal is broken between the container and lid, then the lid is reversed in position, essentially through 180 degrees, to the position illustrated in FIGS. 3, 4 and 4A. In this position the tray surface is facing upwardly as illustrated in FIGS. 3 and 4 and the tray can essentially rest upon the upper peripheral closure edge of the container.

Prior to resting the tray in the "use" position, the tray can be filled with paint from the container. After the tray has been used, any remaining paint can be poured back into the container and the tray is then returned to its "storage" position such as illustrated in FIG. 2A.

One of the advantages of the present invention is that the structure is relatively simple in construction. This combination of paint container and tray essentially includes only two components; namely the container itself and the overlying lid which is adapted to have the two different positions mentioned. Also, in accordance with the present invention, it is preferred that the container be square or rectangular. This assistants in being able to store containers more effectively space wise.

With further reference to FIGS. 1, 2 and 2A, there is disclosed a container 10 that may be considered as having a base portion 12 and an upper peripheral closure edge 14. Opposed side walls of the container 10 may be provided with pockets 15 that form handles for carrying the container and tray.

The combination paint container and tray also includes a lid 20 that is dimensioned so as to be received by and engaged in a sealed manner with the upper peripheral closure edge 14 of the container. The lid is constructed and arranged as a paint tray structure having first and opposed second peripheral edge elements. FIG. 2A illustrates the first peripheral edge element 22 at one side of the lid structure and a second peripheral edge element 24 at the other side of the tray construction. These peripheral edge elements are illustrated as in the form of a wall member that preferably extends continuously about each of the respective container and tray. Disposed between the confining walls of the tray construction is a paint tray wall 25. This wall 25 has a paint receiving surface 26 illustrated in FIG. 3. This surface 26 is preferably slanted as illustrated in FIGS. 3 and 4.

In the embodiment of the invention illustrated in FIGS. 1-5, there is also provided a seal 30 that is adapted to extend about the periphery of the container and tray in order to provide an airtight seal therebetween. FIGS. 1-5 also illustrate a pair of handles 34 that are appropriately secured to the container 10. In FIG. 1, one of the handles is shown in an upper position and the other handle is shown in a downward position. These handles 34, in addition to the pockets 15, can assist in carrying the combination paint container and tray.

Thus, the paint tray in the storage position thereof, such as illustrated in FIGS. 1, 2 and 2A, has the first peripheral edge element 22 for essential sealed engagement with the upper peripheral closure edge 14 of the container 10. Refer in particular to FIG. 2A that shows the peripheral seal 30 that is attached at the junction between the first peripheral edge element and the upper peripheral closure edge of the container. In FIG. 2A there are corresponding wall segments that are joined together. However, other types of interlocking arrangements may be provided so that there is preferably an airtight seal between the container and the overlying lid construction in the "storage" position of the product. Thus, in the storage position the first peripheral edge element of the paint tray is constructed and arranged for releasable interlocking engagement with the upper peripheral closure edge of the container.

In the "use" position of the paint tray, refer to FIGS. 3, 4 and 4A. This position is arrived at after the seal is broken between the container and the lid and the lid is then reversed in position so that the first peripheral edge element 22 is at the top and the second peripheral edge element 24 is at the bottom. Again, refer to the more detailed fragmentary cross-sectional view of FIG. 4A. When the tray is in the "use" position, the second peripheral edge element of the paint tray is constructed and arranged for resting engagement upon the upper peripheral closure edge of the container. This can be a resting position or may provide some type of interlocking between the tray and the container so that the tray is sufficiently secured in position over the container. Refer also to the perspective view of FIG. 3 that shows the tray in position with the paint receiving surface 26 directed upwardly so that paint can be received within the tray, previously poured from the container. It is also noted that the container may include, adjacent to the upper peripheral closure edge thereof, a peripheral ledge 28 that is disposed below the upper peripheral closure edge of the container. Both the first peripheral edge element and the container upper peripheral closure edge are continuous to provide an airtight seal between the container and the lid. The first peripheral edge element 22 of the paint tray preferably is provided with a step 23 and a free wall extending downwardly from the step as viewed in FIG. 2A and thus disposed inside of the upper peripheral closure edge of the container. It is preferred that this edge element be on the inside so that if there is any residual paint in the tray it will drip into the container. As mentioned previously, the tray preferably includes a slanted wall surface as a paint receiving surface and a flange 36. The flange 36 is disposed under the paint receiving tray surface 26, such as in the use position illustrated in FIGS. 4 and 4A. The flange 36 provides an undersurface that rests on the very top of the upper peripheral closure edge 14 of the container.

Figure 6:
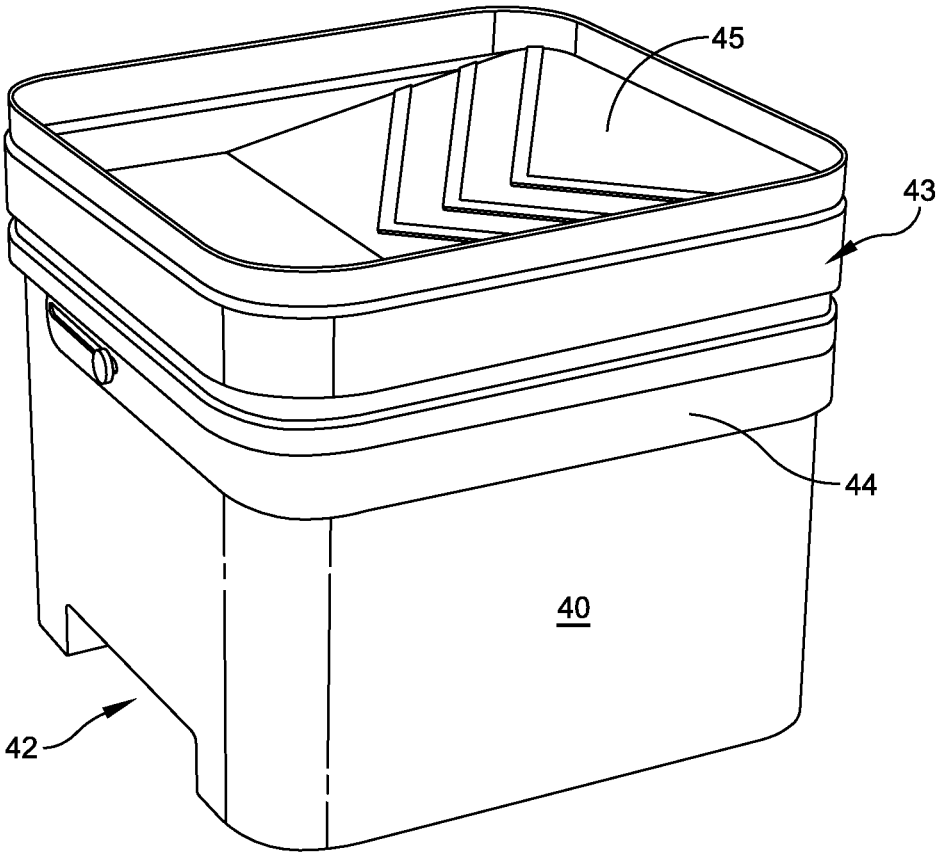
FIG. 6 is a perspective view of an alternate embodiment of the present invention with the container and tray apparatus in the "use" position.
Figure 7:
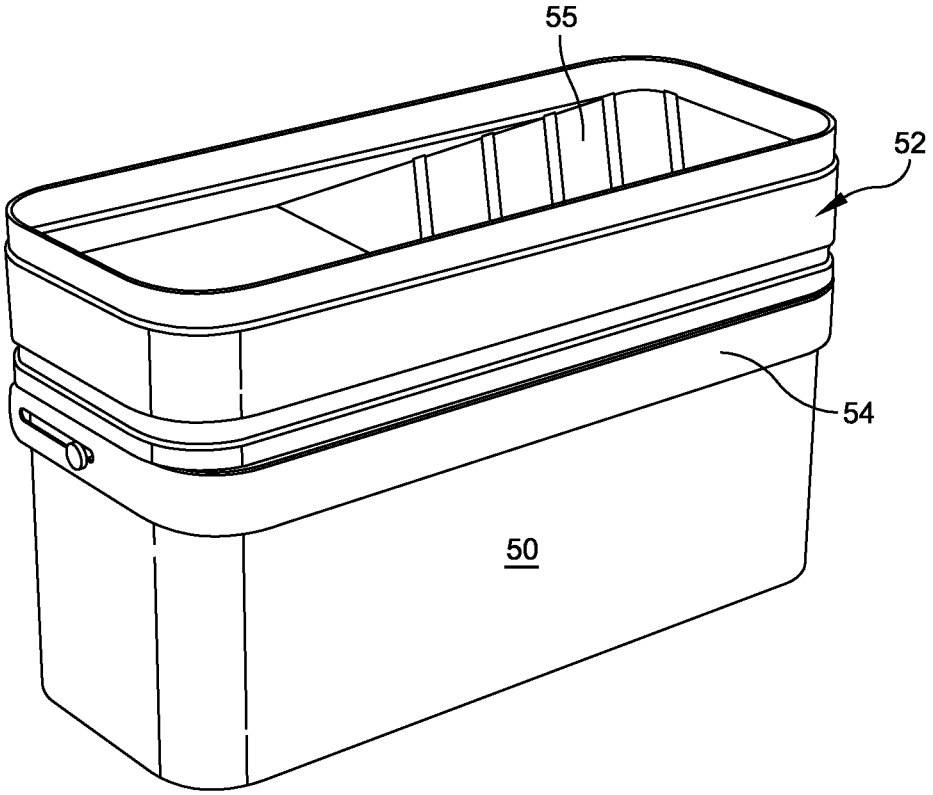
FIG. 7 is a perspective view of an alternate embodiment of the present invention with the container and tray apparatus in the "use" position.

Reference is now made to respective perspective views in FIGS. 6 and 7. The constructions in FIGS. 6 and 7 are substantially the same as previously described in connection with FIGS. 1-5. The primary difference in FIGS. 6 and 7 has to do with the shape and size of the containers. The principles of the present invention can be applied to a great number of different sizes and shapes of container. In FIG. 6 the container 40 is illustrated as having a pair of opposed pocket handles 42 and a single pivoting handle 44. In FIG. 6, the lid is shown in its "use" position with the paint receiving tray surface 45 illustrated in view. Similarly, FIG. 7 shows a more rectangular form of container 50 with a single handle 54 and furthermore illustrating the lid 52 and its "use" position with the paint receiving tray surface 55 in view.

Figure 8:
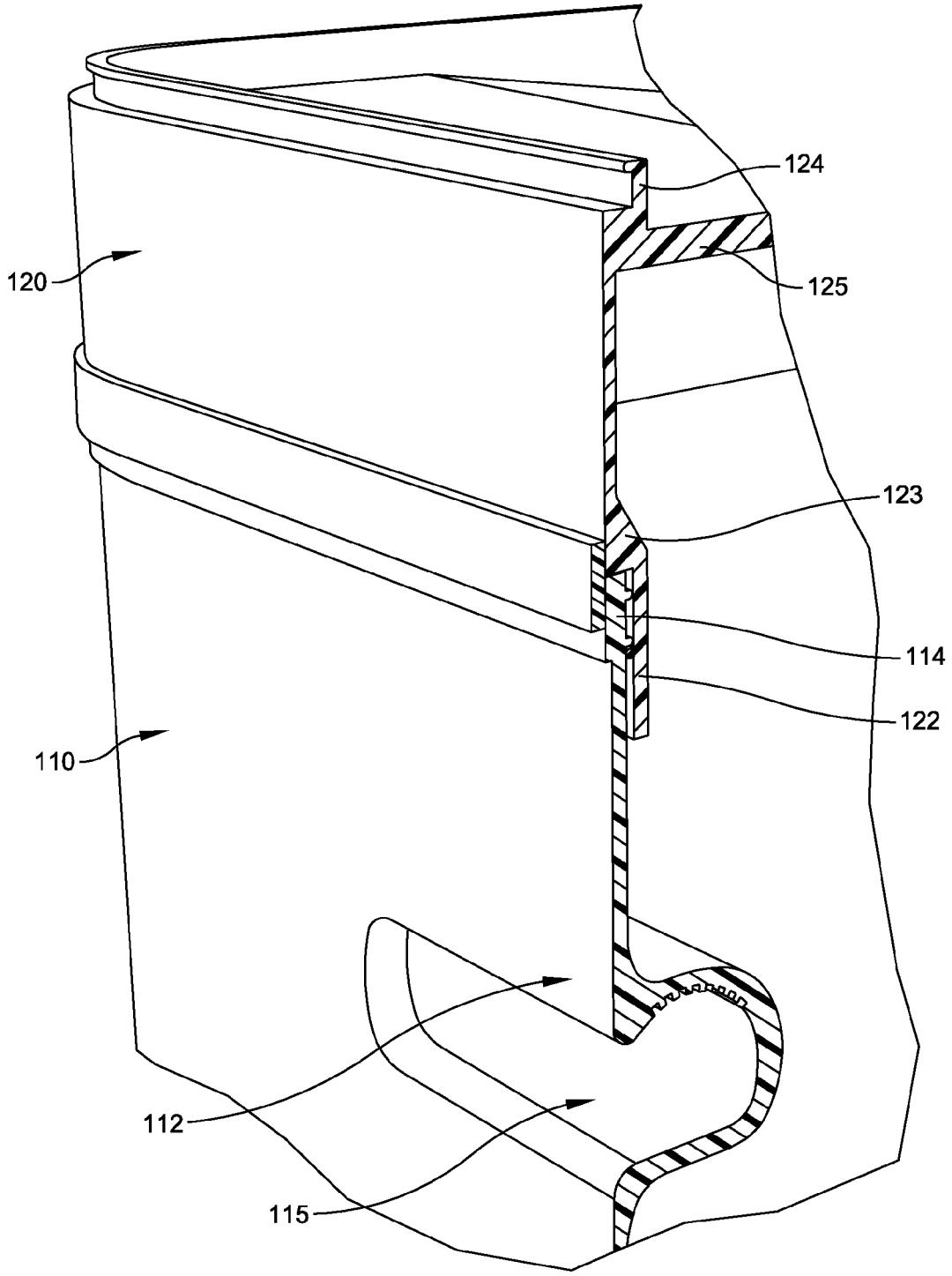
FIG. 8 is a partial cross-sectional perspective view of an alternate embodiment of the invention in the "storage" position.
Figure 8A:
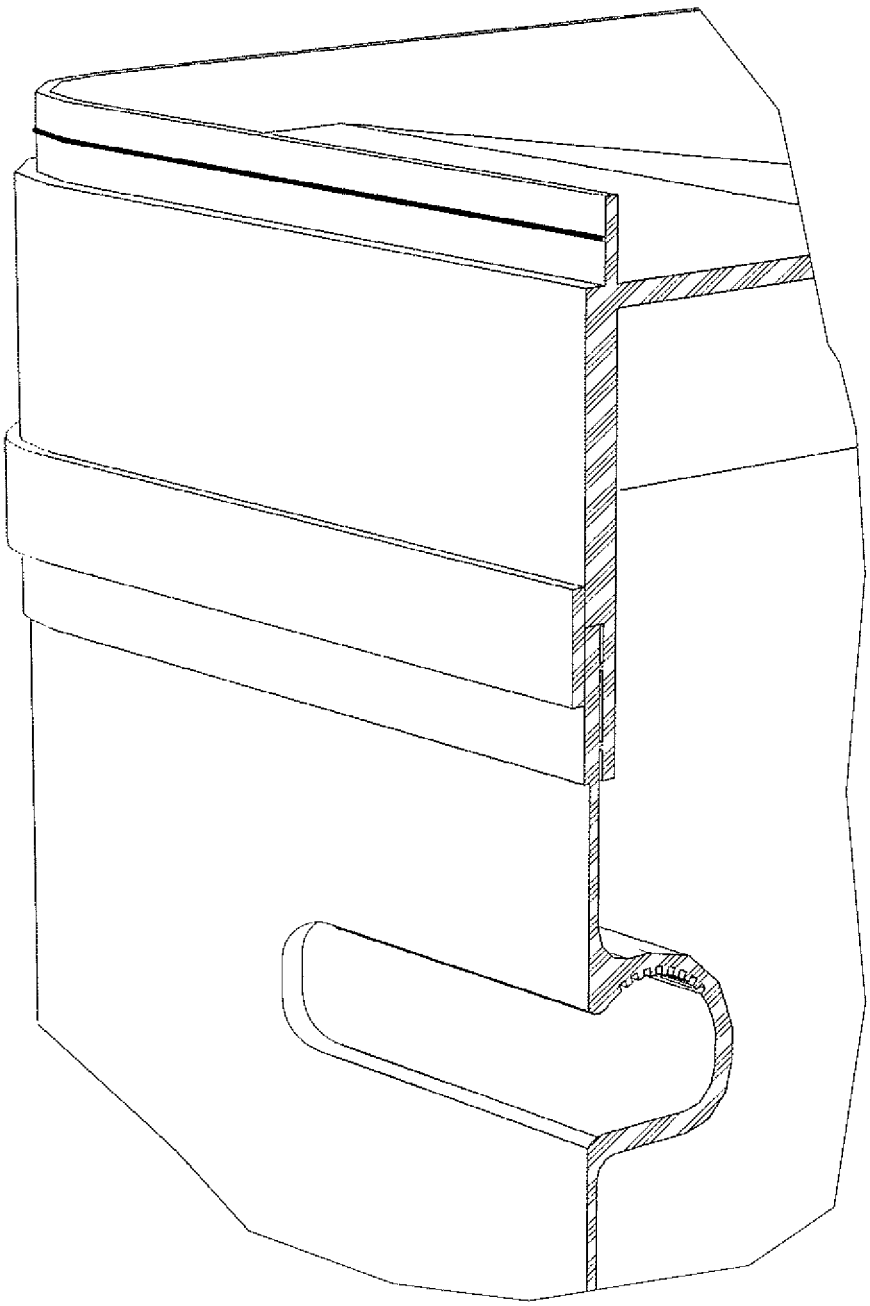
FIG. 8A is a partial cross-sectional perspective view of an alternate embodiment of the invention in the "storage" position.
Figure 9:
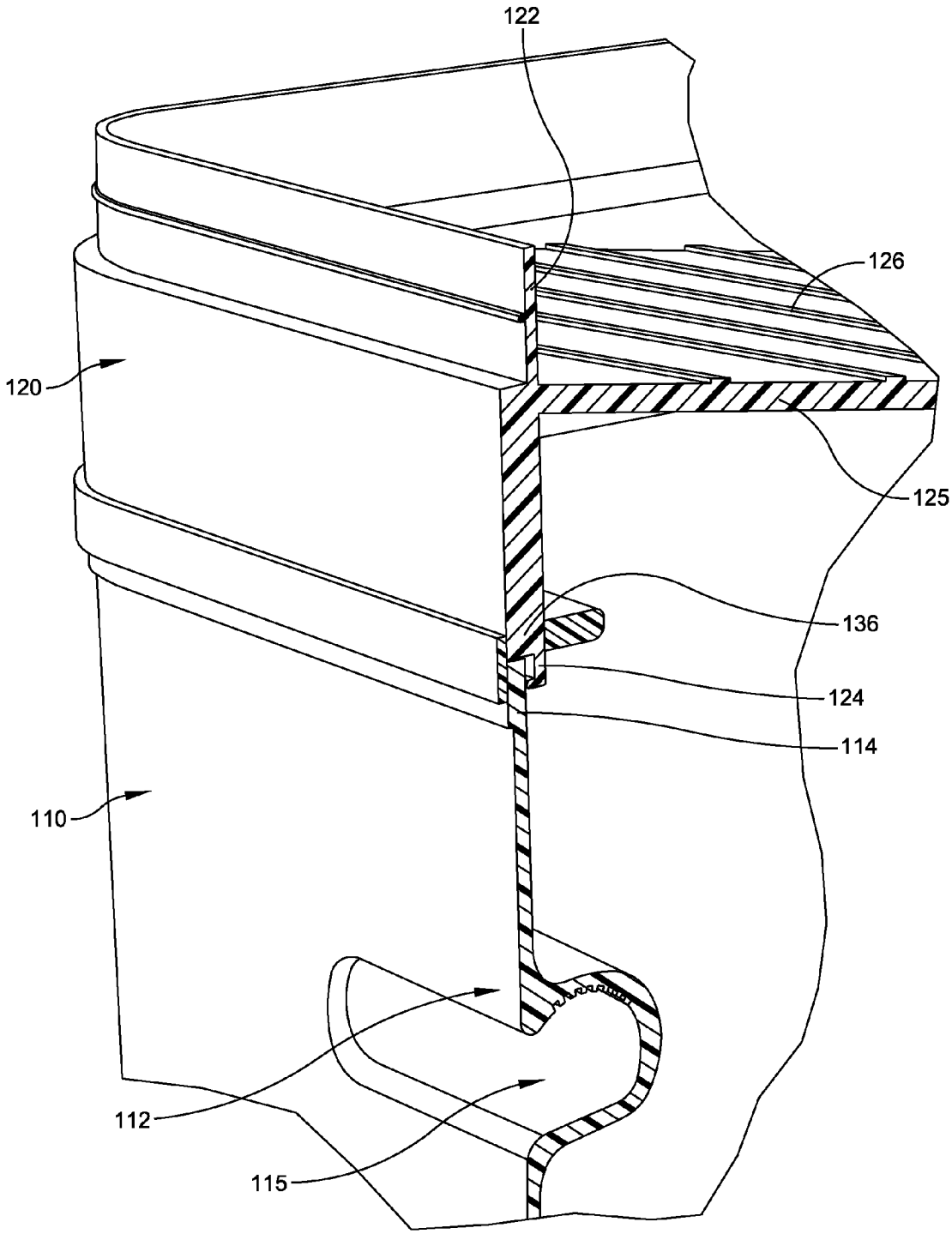
FIG. 9 is a partial perspective cross-sectional view of the embodiment of FIG. 8 in the "use" position.
Figure 9A:
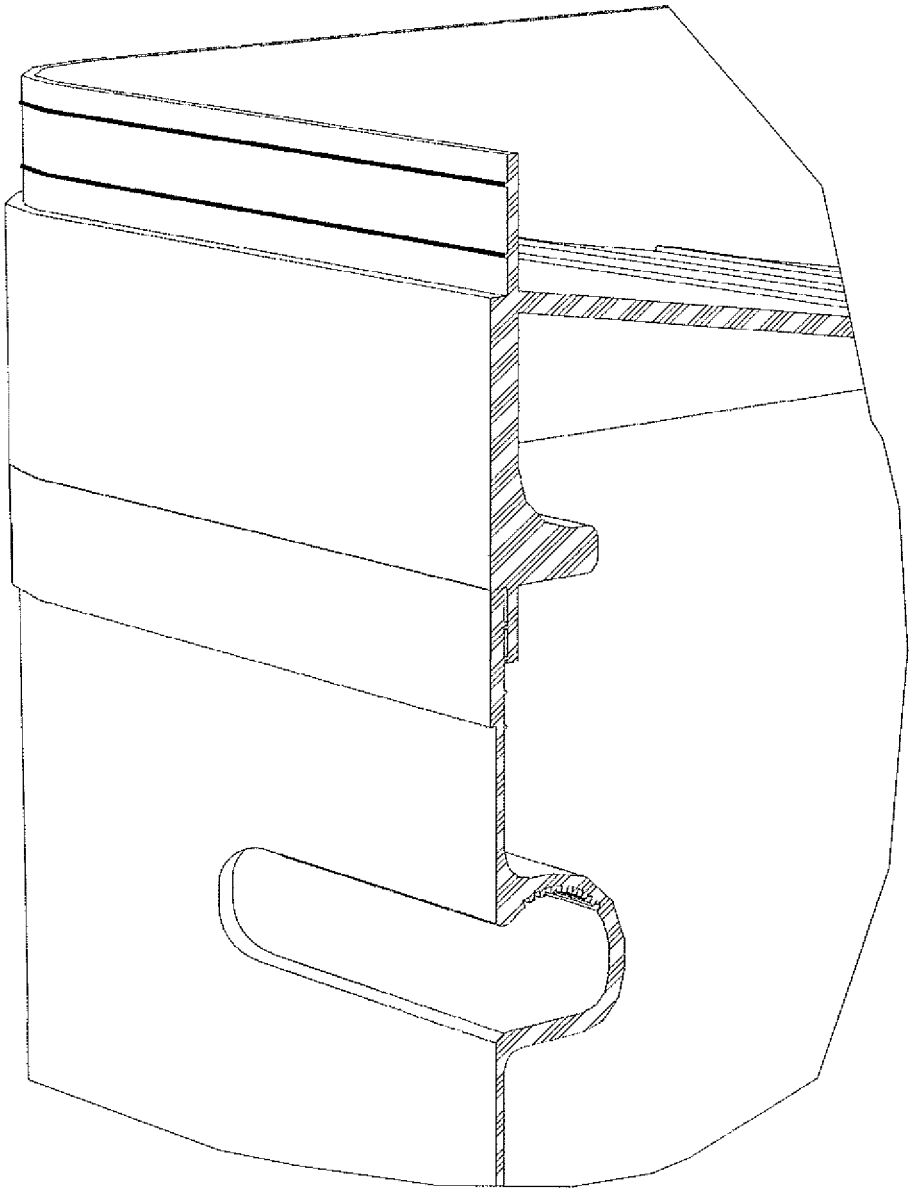
FIG. 9A is a partial perspective cross-sectional view of an alternate embodiment of FIG. 8A in the "use" position.

With further reference to FIGS. 8 and 9, there is disclosed an alternate embodiment of the present invention including a container 110 that may be considered as having a base portion 112 and an upper peripheral closure edge 114. Opposed side walls of the container 110 may be provided with pockets 115 that form handles for carrying the container and tray.

The combination paint container and tray also includes a lid 120 that is dimensioned so as to be received by and engaged in a sealed manner with the upper peripheral closure edge 114 of the container. The lid is constructed and arranged as a paint tray structure having first and opposed second peripheral edge elements. FIG. 8 illustrates the first peripheral edge element 122 at one side of the lid structure and a second peripheral edge element 124 at the other side of the tray construction. These peripheral edge elements are illustrated as in the form of a wall member that preferably extends continuously about each of the respective container and tray. Disposed between the confining walls of the tray construction is a paint tray wall 125. This wall 125 has a paint receiving surface 126 illustrated in FIG. 9. In the embodiment of the invention illustrated in FIGS. 8 and 9, there may also be provided a seal 130 that is adapted to extend about the periphery of the container and tray in order to provide an airtight seal therebetween.

Thus, the paint tray in the storage position thereof, such as illustrated in FIG. 8, has the first peripheral edge element 122 for essential sealed engagement with the upper peripheral closure edge 114 of the container 110. Refer in particular to FIG. 8 that shows the peripheral seal 130 that is attached at the junction between the first peripheral edge element and the upper peripheral closure edge of the container. In FIG. 8 there are corresponding wall segments that are joined together. However, other types of interlocking arrangements may be provided so that there is preferably an airtight seal between the container and the overlying lid construction in the "storage" position of the product. Thus, in the storage position the first peripheral edge element of the paint tray is constructed and arranged for releasable interlocking engagement with the upper peripheral closure edge of the container.

In the "use" position of the paint tray, refer to FIG. 9. This position is arrived at after the seal is broken between the container and the lid and the lid is then reversed in position so that the first peripheral edge element 122 is at the top and the second peripheral edge element 124 is at the bottom. Again, refer to the more detailed fragmentary cross-sectional view of FIG. 9. When the tray is in the "use" position, the second peripheral edge element of the paint tray is constructed and arranged for resting engagement upon the upper peripheral closure edge of the container. This can be a resting position or may provide some type of interlocking between the tray and the container so that the tray is sufficiently secured in position over the container. Refer also to the perspective view of FIG. 3 that shows the tray in position with the paint receiving surface 26 directed upwardly so that paint can be received within the tray, previously poured from the container. It is also noted that the container may include, adjacent to the upper peripheral closure edge thereof, a peripheral ledge that is disposed below the upper peripheral closure edge of the container. Both the first peripheral edge element and the container upper peripheral closure edge are continuous to provide an airtight seal between the container and the lid. The first peripheral edge element 122 of the paint tray preferably may be provided with a step 123 and a free wall extending downwardly from the step as viewed in FIG. 8 and thus disposed inside of the upper peripheral closure edge of the container. It is preferred that this edge element be on the inside so that if there is any residual paint in the tray it will drip into the container. As mentioned previously, the tray preferably includes a slanted wall surface as a paint receiving surface and a flange 136. The flange 136 is disposed under the paint receiving tray surface 126, such as in the use position illustrated in FIG. 9. The flange 136 provides an undersurface that rests on the very top of the upper peripheral closure edge 114 of the container.

Having now described a limited number of embodiments of the present invention, it should be apparent to those skilled in the art that numerous other embodiments and modifications thereof are contemplated as falling within the scope of the present invention. In the "storage" position, it has been indicated that there is a releasable interlocking engagement between the lid and container. This interlocking arrangement can take on many different forms as long as it provides an adequate seal between the lid and the container. For the "use" position, the illustration shows the tray simply resting upon the top edge of the container. However, other types of engaging arrangements may also be provided including other more firm interlocking arrangements between the lid and the container.

What is claimed is:

1. A combination paint container and tray, comprising:

a container for a supply of a paint product including a base and an upper peripheral closure edge;

a lid constructed and arranged as a paint tray structure having first and opposed second peripheral edge elements;

said paint tray having a storage position relative to the container and an opposite use position relative to the container;

said paint tray, in the storage position thereof, having the first peripheral edge element for sealed engagement with the upper peripheral closure edge of the container;

said paint tray, in the use position thereof, having the opposed second peripheral edge element for positioning on the upper peripheral closure edge of the container;

said paint tray, in the use position, having a paint receiving tray surface;

wherein, in the storage position thereof, the first peripheral edge element of the paint tray is constructed and arranged for releasable engagement with the upper peripheral closure edge of the container and includes an upright peripheral sidewall;

wherein, in the use position thereof, the second peripheral edge element of the paint tray is constructed and arranged for resting engagement on the upper peripheral closure edge of the container; and wherein the paint receiving tray surface includes a slanted surface relative to the upright peripheral sidewall and a flange disposed under the paint receiving tray surface in the use position.

2. The combination of claim 1 wherein, in the storage position thereof, the first peripheral edge element of the paint tray is constructed and arranged for releasable interlocking engagement with the upper peripheral closure edge of the container.

3. The combination of claim 1 wherein the second peripheral edge element is defined by parallel arranged straight sidewalls of the paint tray.

4. The combination of claim 1 wherein the container, adjacent to the upper peripheral closure edge thereof, has a peripheral ledge disposed below the upper peripheral closure edge of the container, and both the first peripheral edge element and the container upper peripheral closure edge are continuous to provide an air tight seal between the container and lid.

5. The combination of claim 1 wherein the first peripheral edge element of the paint tray has a step and a free wall that is disposed inside of the upper peripheral closure edge.

6. A combination paint container and tray, comprising:

a container for a supply of a paint product including a base and an upper peripheral closure edge;

a lid constructed and arranged as a paint tray structure having first and opposed second peripheral edge elements;

said paint tray having a storage position relative to the container and an opposite use position relative to the container;

said paint tray, in the storage position thereof, having the first peripheral edge element for sealed engagement with the upper peripheral closure edge of the container;

said paint tray, in the use position thereof, having the opposed second peripheral edge element for positioning on the upper peripheral closure edge of the container;

said paint tray, in the use position, having a paint receiving tray surface;

wherein, in the storage position thereof, the first peripheral edge element of the paint tray is constructed and arranged for releasable interlocking engagement with the upper peripheral closure edge of the container and includes an upright peripheral sidewall;

wherein, in the use position thereof, the second peripheral edge element of the paint tray is constructed and arranged for resting engagement on the upper peripheral closure edge of the container;

wherein the container, adjacent to the upper peripheral closure edge thereof, has a peripheral ledge disposed below the upper peripheral closure edge of the container, and both the first peripheral edge element and the container upper peripheral closure edge are continuous to provide an air tight seal between the container and lid; and wherein the paint receiving tray surface includes a slanted surface relative to the upright peripheral sidewall and a flange disposed under the paint receiving tray surface in the use position.

7. The combination of claim 6 wherein the flange provides an undersurface that rests on the upper peripheral closure edge of the container.

8. The combination of claim 1 wherein the first peripheral edge element and upper peripheral closure edge have respective facing edge surfaces, and further including a sealing strip that covers the facing edge surfaces to provide an air tight seal about the entire periphery of the paint container and tray.

9. The combination of claim 1 wherein the first peripheral edge element includes a step that is engageable with an end section of the upper peripheral closure edge.

10. The combination of claim 1 including opposed indentation in respective opposed walls defining the container and forming handles for carrying the container.

11. The combination of claim 1 wherein the container is one of square or rectangular in cross-section so as to be able to stack containers more efficiently.

12. A paint apparatus that is comprised of a container for a supply of a paint product including a base and an upper peripheral closure edge and a lid that is constructed and arranged as a paint tray structure having first and opposed second sides with each side having respective first and second peripheral edge elements, said paint tray constructed to assume opposite positions relative to the container including a storage position and an opposite use position in which the tray is re-positioned through 180 degrees, said paint tray, in the storage position thereof, having the first peripheral edge element for sealed engagement with the upper peripheral closure edge of the container, said paint tray, in the use position thereof, having the opposed second peripheral edge element for positioning on the upper peripheral closure edge of the container, said paint tray, in the use position, having a paint receiving tray surface facing away from the container; wherein the first and second peripheral edge elements are defined by respective wall members separated by a tray wall that extends substantially orthogonal to and between the respective wall members and having the paint receiving tray surface on the tray wall, and wherein the paint receiving tray surface includes a slanted surface relative to the wall members.

13. The apparatus of claim 12 wherein, in the storage position thereof, the first peripheral edge element of the paint tray is constructed and arranged for releasable interlocking engagement with the upper peripheral closure edge of the container.

14. The apparatus of claim 12 wherein the second peripheral edge element is defined by parallel arranged straight sidewalls of the paint tray.

15. The apparatus of claim 12 wherein the container, adjacent to the upper peripheral closure edge thereof, has a peripheral ledge disposed below the upper peripheral closure edge of the container, and both the first peripheral edge element and the container upper peripheral closure edge are continuous to provide an air tight seal between the container and lid, and wherein the first peripheral edge element of the paint tray has a step and a free wall that is disposed inside of the upper peripheral closure edge.

16. The apparatus of claim 12 wherein the first peripheral edge element of the paint tray has a step and a free wall that is disposed inside of the upper peripheral closure edge.

17. A paint apparatus that is comprised of a container for a supply of a paint product including a base and an upper peripheral closure edge and a lid that is constructed and arranged as a paint tray structure having first and opposed second sides with each side having respective first and second peripheral edge elements, said paint tray constructed to assume opposite positions relative to the container including a storage position and an opposite use position in which the tray is re-positioned through 180 degrees, said paint tray, in the storage position thereof, having the first peripheral edge element for sealed engagement with the upper peripheral closure edge of the container, said paint tray, in the use position thereof, having the opposed second peripheral edge element for positioning on the upper peripheral closure edge of the container, said paint tray, in the use position, having a paint receiving tray surface facing away from the container, wherein, in the storage position thereof, the first peripheral edge element of the paint tray is constructed and arranged for releasable interlocking engagement with the upper peripheral closure edge of the container and includes an upright peripheral sidewall, wherein, in the use position thereof, the second peripheral edge element of the paint tray is constructed and arranged for resting engagement on the upper peripheral closure edge of the container, wherein the container, adjacent to the upper peripheral closure edge thereof, has a peripheral ledge disposed below the upper peripheral closure edge of the container, and both the first peripheral edge element and the container upper peripheral closure edge are continuous to provide an air tight seal between the container and lid, and wherein the first peripheral edge element of the paint tray has a step and a free wall that is disposed inside of the upper peripheral closure edge, and wherein the paint receiving tray surface includes a slanted surface relative to the upright peripheral sidewall and a flange disposed under the paint receiving tray surface in the use position, and wherein the flange provides an undersurface that rests on the upper peripheral closure edge of the container.

18. The apparatus of claim 12 wherein the first peripheral edge element and upper peripheral closure edge have respective facing edge surfaces, and further including a sealing strip that covers the facing edge surfaces to provide an air tight seal about the entire periphery of the paint container and tray.

19. The apparatus of claim 12 wherein the first peripheral edge element includes a free end that is engageable with a free end of the upper peripheral closure edge.

20. The apparatus of claim 12 including a flange disposed under the paint receiving tray surface in the use position, and wherein the flange provides an undersurface that rests on the upper peripheral closure edge of the container.

21. The apparatus of claim 12 wherein a portion of the tray wall has the slanted surface and another portion thereof has a substantially horizontally disposed surface.

* * * * *